US007185965B2

(12) United States Patent
Takada et al.

(10) Patent No.: US 7,185,965 B2
(45) Date of Patent: Mar. 6, 2007

(54) INKJET RECORDING APPARATUS AND RECOVERY CONTROL AFTER INTERRUPTION OF ITS RECORDING OPERATION

(75) Inventors: Yoshihiro Takada, Tokyo (JP); Kenshi Hata, Tokyo (JP); Katsushi Hara, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 141 days.

(21) Appl. No.: 10/690,516

(22) Filed: Oct. 23, 2003

(65) Prior Publication Data

US 2004/0085376 A1 May 6, 2004

(30) Foreign Application Priority Data

Oct. 29, 2002 (JP) ..... 2002-314596

(51) Int. Cl.
*B41J 29/38* (2006.01)
*B41J 2/05* (2006.01)

(52) U.S. Cl. ..... 347/17; 347/60

(58) Field of Classification Search ..... 347/17, 347/60, 18, 61, 19, 9
See application file for complete search history.

(56) References Cited

U.S. PATENT DOCUMENTS 5,576,746 A 11/1996 Suzuki et al.
5,689,292 A * 11/1997 Suzuki et al. ..... 347/17
6,126,266 A * 10/2000 Numata et al. ..... 347/23
6,139,125 A * 10/2000 Otsuka et al. ..... 347/11
6,193,344 B1 * 2/2001 Otsuka et al. ..... 347/11
6,406,113 B1 * 6/2002 Kato ..... 347/14
6,527,355 B1 * 3/2003 Yang et al. ..... 347/14
6,767,080 B2 * 7/2004 Kanematsu ..... 347/60
6,820,955 B1 * 11/2004 Usui ..... 347/7
2002/0041300 A1 * 4/2002 Iwasaki et al. ..... 347/19

FOREIGN PATENT DOCUMENTS

JP 6-328723 11/1994

* cited by examiner

*Primary Examiner*—Stephen Meier
*Assistant Examiner*—Rene Garcia, Jr.
(74) *Attorney, Agent, or Firm*—Fitzpatrick, Cella, Harper & Scinto

(57) ABSTRACT

An inkjet recording apparatus has a structure in which, when a recording-interruption operation of a recording head such as discharge-recovery processing is performed during an image-forming operation, a recording downtime is measured, and the recording head is heated in accordance with the length of a recording downtime so as to prevent occurrence of differences in optical densities and colors of an image before and after the recording-interruption operation.

11 Claims, 11 Drawing Sheets

| | Tb1 | Tb2 | Tb3 | Tb4 | Ta1 | Ta2 | Ta3 | Ta4 |
|---|---|---|---|---|---|---|---|---|
| TEMPERATURE OF RECORDING HEADS | 33°C | 49°C | 41°C | 37°C | 40°C | 55°C | 50°C | 44°C |
| | Tave2 = 40°C | | | | Tave1 = 47.3°C | | | |

| RECORDING DOWNTIME ti | 0 | t1 | tα | t2 | t3 | tβ | t4 |
|---|---|---|---|---|---|---|---|
| NUMBER OF APPLIED PULSES N | 0 | 0 | 0 | h(t2) | h(t3) | h(tβ) | h(tβ) |

FIG. 18

| INK COLOR | RECORDING DOWNTIME ti | tαc | t1 | tαpc | t2 | t3 | t4 | tβpc | t5 | tβc |
|---|---|---|---|---|---|---|---|---|---|---|
| | C | 0 | f(t1) | f(tαpc) | f(t2) | f(t3) | f(t4) | f(tβpc) | f(t5) | f(tβc) |
| | Pc | 0 | 0 | 0 | g(t2) | g(t3) | g(t4) | g(tβpc) | g(tβpc) | g(tβpc) |

INKJET RECORDING APPARATUS AND RECOVERY CONTROL AFTER INTERRUPTION OF ITS RECORDING OPERATION

BACKGROUND OF THE INVENTION

1. Field of the Invention

The present invention relates to inkjet recording apparatuses, and more particularly, it is related to an inkjet recording apparatus having a mechanism for correcting an uneven density when a recording operation of a continuous image is interrupted and is then resumed.

2. Description of the Related Art

An inkjet recording apparatus for recording an image by discharging ink towards a recording medium (recording material) such as a sheet of paper, a sheet of cloth, a plastic sheet, or an overhead projector (OHP) sheet on the basis of image data (recording data) is widely used as a recording apparatus having a function of a printer, a copying machine, or a facsimile machine, or as a recording apparatus (a printing apparatus) serving as an output device of a combined electronic device including a computer and a word processor, a workstation, or the like.

In order to meet a variety of requirements for recording media composed of new materials, in recent years, there has been developed a recording apparatus in which recording media composed of materials such as cloth, leather, unwoven cloth, and metal, other than normal recording media such as sheets of paper (including a thin sheet of paper and a sheet of converted paper) and thin plastic sheets (including an OHP sheet) are used.

Since the majority of the foregoing inkjet recording apparatuses are of a so-called serial scan type in which an image is recorded while a recording head performs scanning operations a plurality of times in a direction (main-scan direction) intersecting with the forwarding direction (the sub-scan direction) of a recording medium, and have a reduced size of a recording head unit and a low cost structure, a large number of inkjet recording apparatuses have been commercialized from various manufacturers.

In such an inkjet recording apparatus of a serial scan type, when a recording operation is performed, ink mist produced when ink is discharged from a recording head, splash mist produced due to an impact occurring when discharged ink reaches a recording material, or the like sometimes accretes on a discharge-port surface of the recording heads. Accordingly, there is a risk in that discharge ports of the recording heads are clogged with the accreted ink mist, thereby leading to a failure in discharging ink.

In order to solve the above problem, the foregoing recording apparatus is constructed such that the ink mist accreted around the discharge ports is wiped and removed by providing a wiping blade composed of a rubber-like elastic member such as polyurethane rubber and by moving the recording heads in a state in which the wiping blade abuts against the discharge-port surface of the recording heads. Such a discharge-recovery operation is called a wiping operation.

Also, since an image is formed by selectively discharging ink from the plurality of discharge ports of the recording heads during the recording operation, some of the discharge ports formed at the fronts of nozzles of the recording heads may remain in contact with the air without ink being discharged therefrom. In such nozzles, since ink in the nozzles gets evaporated and dried, and thus has an increased viscosity, the amount of discharged ink decreases and a discharge speed of ink decreases, thereby sometimes causing a discharge failure such as a wrong discharge direction. In order to remove the evaporated and dried ink having an increased viscosity, the discharge failure is prevented from occurring by discharging ink, unrelated to the recording operation, from the nozzles of the recording heads towards an object other than a recording medium. Such a discharge-recovery operation is called a preliminary discharge operation.

Also, when the recording operation of each recording head is continuously performed for a long time, the temperature of the recording head increases due to the heat stored when recording ink is discharged, which causes gas in a form of a bubble to be mixed in an ink holder (common ink chamber) or the like placed in the vicinity of the nozzle of the recording head. When the bubble is inflated to a certain extent, the bubble sometimes prevents ink from being fed to the nozzle, and resultantly from being normally discharged. In order to solve the above-mentioned problem, a cap composed of rubber or the like is disposed so as to abut against the discharge-port surface of the recording heads (i.e., the surface in which the discharge ports of the recording heads are formed), so that bubbles together with ink remaining in the vicinities of the nozzles are forcefully sucked and discharged via the cap. Such a discharge-recovery operation is called a sucking operation.

By performing such a discharge-recovery operation of the recording heads before or after an image-forming operation, or during a standby time midway through the image-forming operation and before the start of the subsequent scanning operation, ink is normally discharged from the recording heads, thereby preventing degradation of image quality and thus always forming a high-quality image.

In the meantime, when an image-forming operation such as a long-banner printing operation for forming an image in a large area is performed, sometimes it is required to perform such a discharge-recovery operation in order to always form a high-quality image even when the recording operation is interrupted midway through the image-forming operation.

More particularly, since thermal energy for continuously discharging recording-ink for a long time is supplied to the recording heads, the temperatures of the recording heads during the recording operation such as the long-banner printing operation are higher than those immediately after the start of the recording operation.

Accordingly, when the wiping operation serving as the foregoing discharge-recovery operation is performed during a standby time midway through the recording operation and before the start of the subsequent scanning operation, since no thermal energy is continuously supplied to ink during the wiping operation, and also the temperatures of the recording heads midway through the recording operation are higher than an ambient temperature around the inkjet recording apparatus, the temperatures of the recording heads immediately after the resumption of the recording operation are lower than those before the discharge-recovery operation due to heat radiation during the discharge-recovery operation.

Likewise, when the preliminary discharge operation serving as the foregoing discharge-recovery operation is performed during a standby time midway through the recording operation and before the start of the subsequent scanning operation, although thermal energy is supplied to ink during the preliminary discharge operation, since the amount of thermal energy continuously supplied to the recording heads is smaller than that during the image-forming operation, thermal radiation during the discharge-recovery operation has a large influence on the temperatures of the recording heads, and hence the temperatures immediately after the resumption of the recording operation are lower than those before the discharge-recovery operation.

Also, when the sucking operation serving as the foregoing discharge-recovery operation is performed during a standby time midway through the recording operation and before the start of the subsequent scanning operation, since no thermal energy is continuously supplied to the recording heads during the sucking operation, and also, in addition to heat radiation during the discharge-recovery operation, the sucking operation causes ink in an ink-feeding path for feeding ink to the recording heads to flow into the recording head, the recording heads are cooled down, whereby the temperatures of the recording heads immediately after the resumption of the recording operation are further lower than those before the discharge-recovery operation such as the wiping operation, or the preliminary discharge operation.

Unfortunately, such known discharge-recovery operations have the following problems which must be solved. A temperature of ink in the inkjet recording heads is very important to maintain the amount of the ink discharged from the recording heads constant. That is, a viscosity and a surface tension of the ink vary in accordance with the temperature thereof, thereby causing the amount of discharged ink to vary.

In order to solve the above problem, when the discharge-recovery operation of the recording heads is performed during a standby time midway through the image-forming operation and before the start of the subsequent scanning operation so as to normally discharge ink from the recording heads, to prevent degradation of image quality, and thus to always form a high-quality image, the ink temperatures of the recording heads immediately after the resumption of the image-forming operation become lower than those before the discharge-recovery operation, thereby decreasing the amount of discharged ink and thus decreasing an optical density of the image.

In addition, in the case where the recording operation is performed by transferring a large amount of image data to the inkjet recording apparatus with image-data transfer means such as an interface as in the case of the long-banner printing operation, when the recording operation is performed under a printing configuration in which the transfer rate of the image data is lower than the recording speed of the inkjet recording apparatus, sometimes it is required to temporally interrupt the recording operation until the image data is transferred to a host device and then to resume the recording operation after the finish of transferring the image data. On this occasion, since the length of a downtime of the recording operation depends on a processing speed of a CPU of the host device connected to the inkjet recording apparatus, a specification of the interface, and the amount of recording image data, a decrease in an optical density due to decreases in the temperatures of the recording heads caused by heat radiation during the downtime of the recording operation and a printing interruption of the recording heads is not uniquely determined but varies greatly depending on a user configuration.

Also, since the foregoing decrease in the optical density during the printing interruption takes place in mutually adjacent image-forming regions before and after the printing interruption, even a slight decrease in the optical density is significantly noticeable with respect to an actually printed image, thereby degrading image quality.

Meanwhile, in order to remove a strain caused by an ink drop accreted on the discharge-port surface of the recording heads, for example, Japanese Unexamined Patent Application Publication No. 6-328723 has disclosed a technique with which the discharge-port surface is cleaned by making ink in the nozzles to overflow towards the discharge-port surface, and then the temperatures of the recording heads are returned to those immediately before cleaning the discharge-port surface.

Although a recording apparatus according to the above-mentioned technique has a structure in which, after the discharge-port surface is cleaned, the temperatures of the recording heads are returned to those immediately before cleaning the discharge-port surface by recording-head heating means, unfortunately, due consideration has not been given to affects of the interruption of the recording operation and the length of the downtime of the recording operation, other than the above cleaning operation of the recording heads, on the optical density of an image.

SUMMARY OF THE INVENTION

The present invention has been made in view of the above problems. Accordingly, it is an object of the present invention to provide an inkjet recording apparatus in which, even when a recording-interruption operation of recording heads is performed during a recording operation of the recording heads, differences in optical densities and colors of a recording image before and after the interruption of the recording operation are prevented from occurring.

An example recording apparatus according to the present invention includes a timer for measuring a recording downtime when an image-recording operation of at least one recording head is interrupted during the recording operation and is then resumed; and control means for performing a temperature control of the recording head before the resumption of the recording operation in accordance with the length of the recording downtime measured by the timer.

Also, an example control method of a recording apparatus according the present invention includes the steps of measuring a recording downtime with a timer when an image-recording operation of at least one recording head is temporally interrupted during the recording operation and is then resumed; and performing a temperature control of the recording head before the resumption of the recording operation in accordance with the length of the recording downtime measured by the timer.

With the above-described structure of the inkjet recording apparatus according to the present invention, factors such as blurring which vary in accordance with the length of a recording downtime are prevented, thereby recording a high quality image without causing differences in optical densities and colors of a recording image before and after the interruption of the recording operation to occur.

Further objects, features and advantages of the present invention will become apparent from the following description of the preferred embodiments with reference to the attached drawings.

BRIEF DESCRIPTION OF THE DRAWINGS

FIG. 18 is a correction table showing the relationships between a recording downtime and the numbers of blur-correction pulses of images recorded with the mutually different colors of ink.

DESCRIPTION OF THE PREFERRED EMBODIMENTS

Preferred embodiments of the present invention will be described with reference to the accompanying drawings.

First Embodiment

Figure 1:
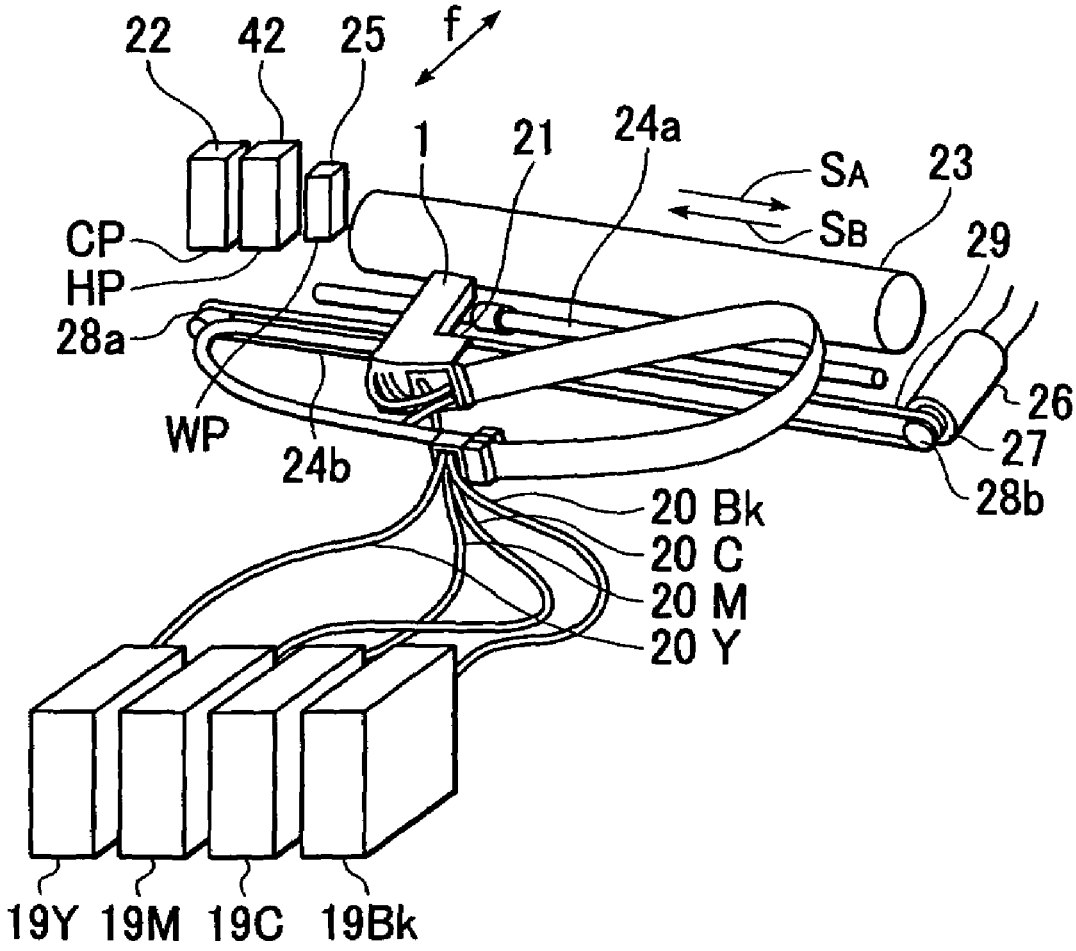
FIG. 1 is a schematic perspective view of the common structure of inkjet recording apparatuses according to first and second embodiments of the present invention.

FIG. 1 is a schematic perspective view illustrating the common structure of inkjet recording apparatuses according to embodiments of the present invention. As shown in FIG. 1, a recording medium (not shown) in a form of a continuous roll of paper or a cut sheet is forwarded between recording heads 1 and a platen roller 23 for forming and maintaining a recording surface of the recording, medium, while being pressed by a pinch roller (not shown) onto the platen roller 23. The recording heads 1 are mounted on a carriage 21 and are driven so as to perform serial scanning operations in the SA and SB directions indicated in the figure along two guide rails 24*a* and 24*b* so as to record an image on the recording medium. The carriage 21 is connected to a shaft 27 of a motor 26, having pulleys 28*a* and 28*b* and a belt 29 entrained about the pulleys 28*a* and 28*b* interposed therebetween, and is driven in the SA and SB directions in accordance with a rotation of the motor 26.

The recording heads 1 have four recording units corresponding to four colors: for example, yellow (Y), magenta (M), cyan (C), and black (Bk). The recording units recording an image with the Y, M, C, and Bk colors have respective ink-feeding paths, and are fed with four kinds of ink for the Y, M, C, and Bk colors from ink tanks 19Y, 19M, 19C, and 19Bk through ink feeding pipes 20Y, 20M, 20C, and 20Bk, respectively.

Capping means 22, a suction cap 42, and wiping means 25 are disposed outside an area where an image is recorded by the recording heads. In a state in which the carriage 21 having the recording heads 1 mounted thereon moves to a home position HP and the suction cap 42 is opposed to the recording heads 1, the suction cap 42 moves in the directions of the arrow f indicated in the figure so as to abut against a discharge-port surface of the recording heads 1, and then performs a discharge-recovery operation.

Likewise, in a state in which the carriage 21 moves to a capping position CP, and then the capping means 22 is opposed to the recording heads 1, the capping means 22 moves in the directions of the arrow f so as to abut against the discharge-port surface of the recording heads 1 and then performs a capping operation.

Likewise, in a state in which the carriage 21 moves to a wiping position WP, and then the wiping means 25 is opposed to the recording heads 1, the wiping means 25 moves in the directions of the arrow f so as to abut against the discharge-port surface of the recording heads 1 and then performs a wiping operation.

With this arrangement, when one of the inkjet recording apparatuses receives recording image data through interface means (not shown), in order to record the data on the recording medium forwarded by a paper-forwarding unit (not shown), the recording apparatus is controlled such that the carriage 21 having the recording heads 1 mounted thereon performs scanning operations in the main scan directions, that is, in the SA and SB directions. When the recording apparatus records an image corresponding to one scanning operation, the recording medium is forwarded in a direction (sub-scan direction) perpendicular to the traveling directions of the carriage 21, by an amount of one band corresponding to the width of the image recorded in the one scanning operation with the main scanning operation.

The carriage 21 has an encoder film (not shown) disposed in the vicinity thereof and an encoder sensor (not shown) mounted thereon so as to detect an absolute position thereof, and the recording apparatus is controlled such that the encoder sensor reads the encoder film so as to detect the absolute position.

Thus, by making the carriage 21 to scan on the basis of a position-detected signal from the encoder sensor, the carriage 21 is halted at each of the wiping position WP, the home position HP, and the capping position CP.

The recording heads 1 according to a first embodiment have 256 discharge ports disposed at intervals of 600 dpi (dots/inch, about 236 dots/cm) in the sub-scan direction, and an ink-flow path in communication with each discharge port has an electrothermal conversion member disposed therein for locally heating ink in the ink-flow path so as to generate film-boiling of the ink and thus to discharge the ink with the pressure produced by the film-boiling.

Also, the inkjet recording heads 1 have a temperature sensor 50 (see FIG. 2) for detecting the temperatures thereof disposed on the same board as that on which the electrothermal conversion members are disposed.

Figure 2:
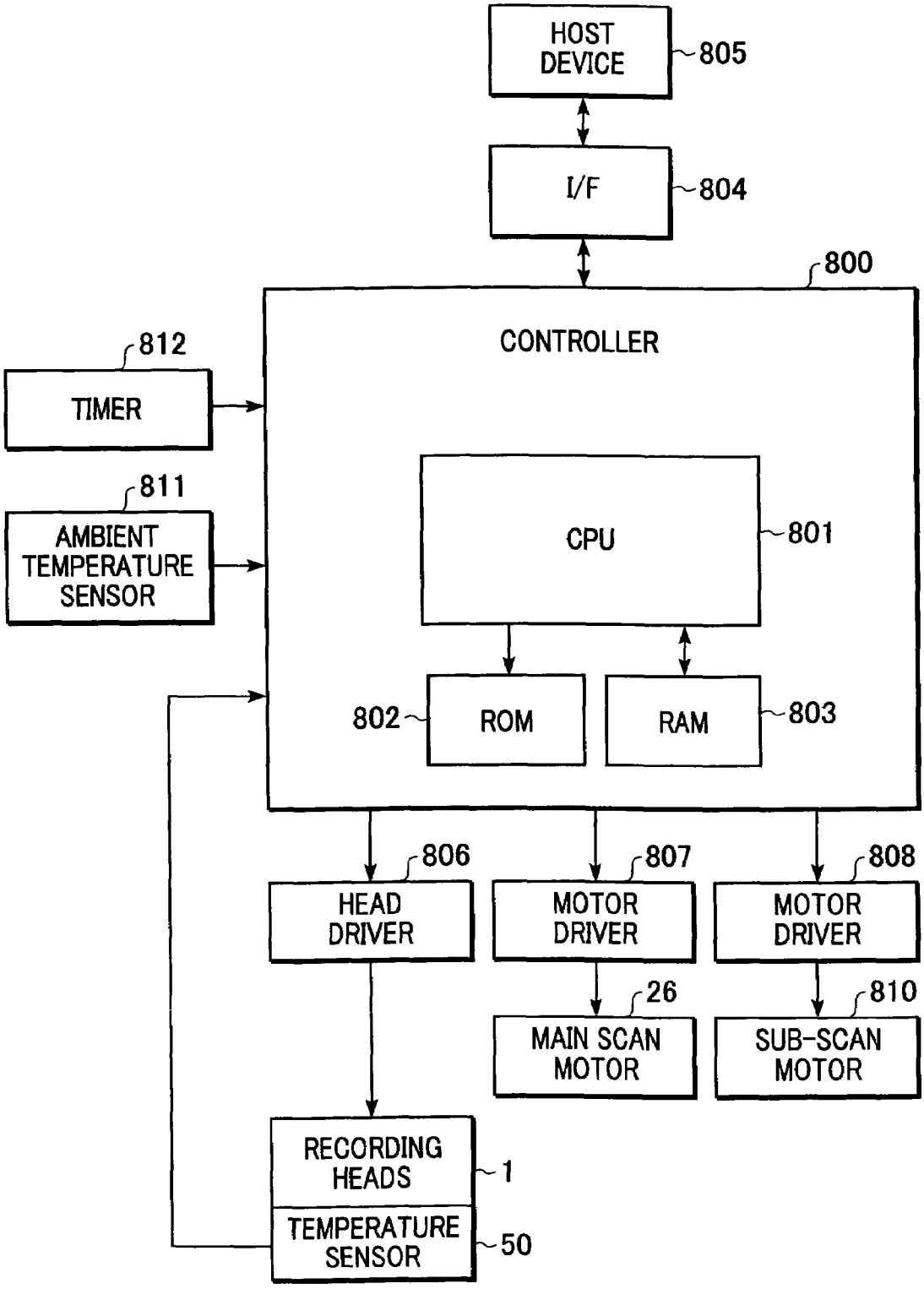
FIG. 2 is a block diagram of an example configuration of a control system of the inkjet apparatus according to the first embodiment of the present invention.

FIG. 2 is a block diagram illustrating an example configuration of a control system of the recording apparatus according to a first embodiment of the present invention.

As shown in FIG. 2, a controller 800 serving as a main control unit includes a CPU 801 in a form of, for example, a microcomputer, for executing a sequence, which will be described later, and the like; a ROM 802 for storing a program corresponding to the procedure of the sequence, a variety of conversion tables, and fixed data including a voltage value and a pulse width of a heating drive pulse applied on the recording heads; and a RAM 803 for providing an image-data developing area, a working area, and the like.

An ambient temperature detected by an ambient temperature sensor 811 is inputted into the controller 800 and is used to calibrate an output value of the temperature sensor 50 mounted on of the recording heads 1, for detecting temperatures of the recording heads.

A timer 812 serves as recording-downtime detecting means, which will be described later, for measuring a printing-operation downtime of the recording heads.

A host device 805 serving as a source for supplying recording image data sends and receives recording image data, commands and status signals, and so forth, to and from the controller 800 disposed in the main body of the inkjet recording apparatus via interface (I/F) means 804.

A head driver 806 drives the electrothermal conversion members (discharging heaters) of the recording heads in accordance with recording image data and so forth. When temperature values detected by the temperature sensor 50 for detecting the temperatures of the recording heads are inputted into the controller 800, and the controller 800 instructs the head driver 806 so as to input optimal drive pulse signals to the recording heads 1 in accordance with the detected temperature values, the recording apparatus performs an discharge operation for discharging recording ink from the recording heads 1.

The motor 26 serving as a main scanning motor moves the carriage 21 in the main scan directions, while being driven by a motor driver 807. A sub-scan motor 801 forwards the recording medium (performs a sub-scanning operation), while being driven by a motor driver 808.

In the foregoing inkjet recording apparatus, a temperature control of the recording heads performed when discharge-recovery processing serving as a printing-interruption operation is performed midway through an image-forming operation will be described.

Figure 3:
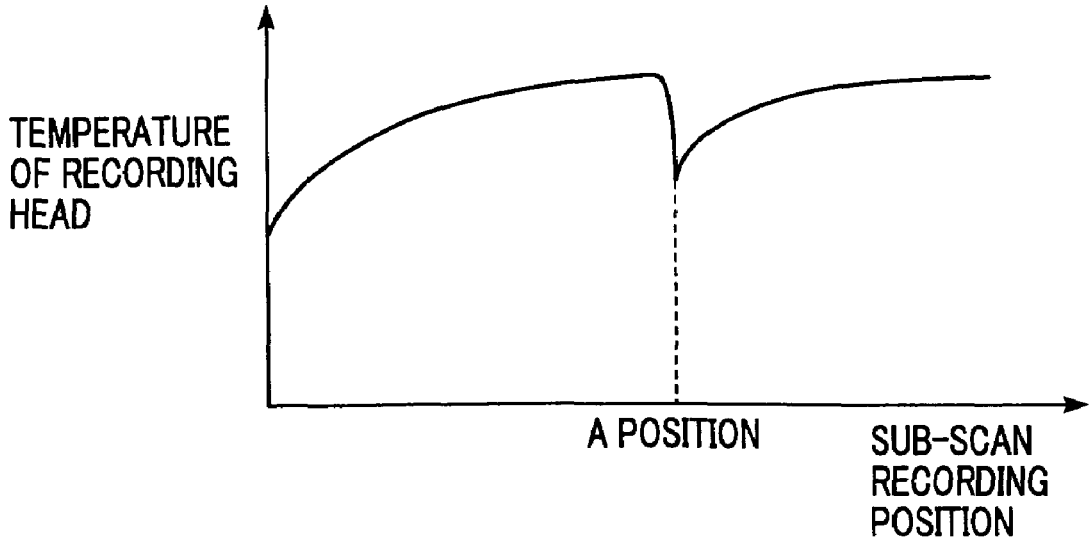
FIG. 3 is a graph illustrating how a temperature of one of recording heads changes when a temperature control of the recording heads is not performed after a sucking operation serving as discharge-recovery processing is performed midway through an image-forming operation.

FIG. 3 is a graph illustrating how a temperature of one of the recording heads changes when a temperature control of the recording heads is not performed after a sucking operation serving as the discharge-recovery processing is performed. A sub-scan recording position A shown in FIG. 3 represents a position where a sucking operation serving as a printing-interruption operation is performed during a recording operation. Since thermal energy for discharging ink is continuously supplied to the recording head, the temperature of the recording head during an image-forming operation, lying in a position preceding the position A, is higher than that immediately after the start of the image-forming operation. Meanwhile, since no thermal energy is continuously supplied to the recording head during the sucking operation, and in addition to thermal radiation during the discharge-recovery operation, also since the sucking operation causes low-temperature ink in an ink-feeding path for feeding ink to the recording head to flow into the recording head and the recording head to be cooled down, the temperature of the recording head lying in a position succeeding the sub-scan recording position A and immediately after the resumption of the image-recording operation is lower than that before the discharge-recovery operation.

Figure 4:
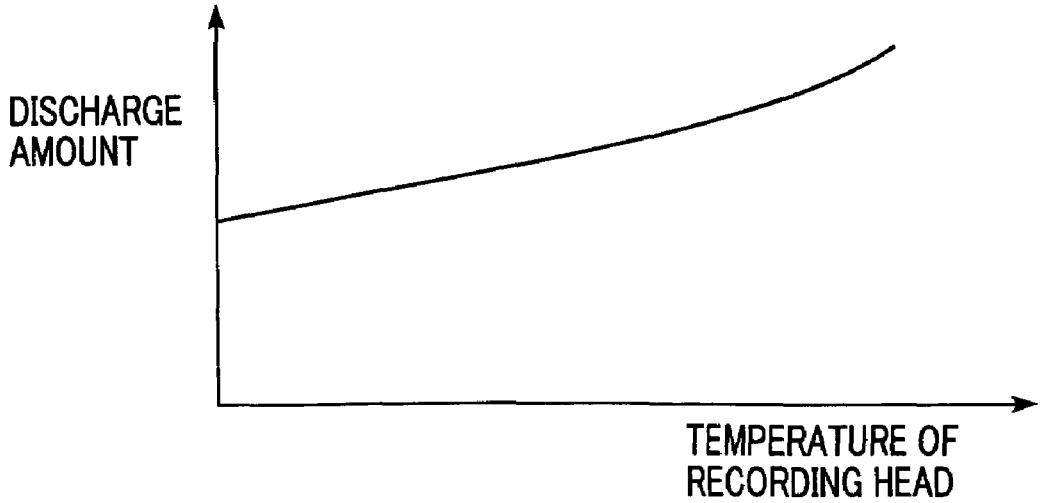
FIG. 4 is a graph illustrating the relationship between a temperature of the recording head and the amount of discharged ink.

In the meantime, as shown in FIG. 4, in the inkjet recording apparatus for performing the recording operation by discharging liquid recording ink, since the temperature of the recording ink in an ink chamber of the recording head increases as the temperature of the recording head increases, the viscosity of the recording ink decreases, thereby resulting in an increased amount of discharged ink from the recording head.

Figures 5, 6:
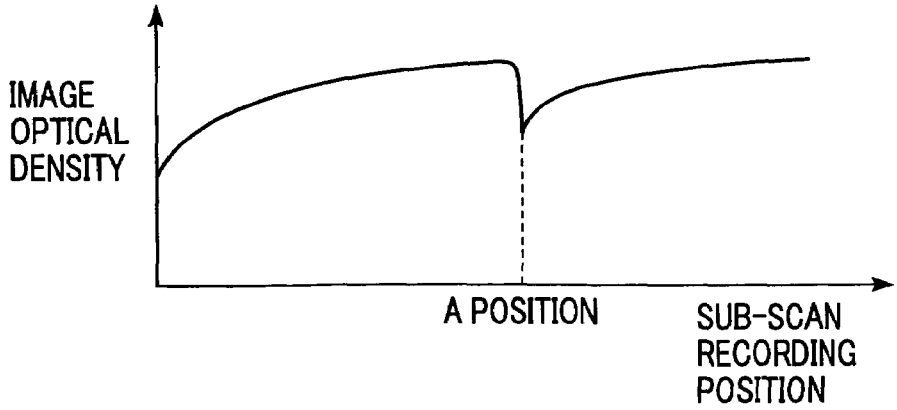
FIG. 5 is a graph illustrating an image optical density after the sucking operation serving as the discharge-recovery processing is performed midway through the image-forming operation.
FIG. 6 is a table showing temperatures of the recording heads in the first embodiment.

As a result, as shown in FIG. 5, when the recording operation is resumed so as to form an image after the sucking operation serving as the discharge-recovery processing is performed and the recording operation is interrupted, a change in image optical densities takes place between the positions immediately preceding and succeeding the sub-scan recording position A (the position at which the sucking operation is performed). Since the change in optical densities before and after the interruption of the recording operation takes place in mutually adjacent image forming regions before and after the interruption, even a slight decrease in an optical density (for example, a difference in optical densities of about 0.02) is significantly noticeable in an actually printed image, thereby causing a serious problem from the viewpoint of image quality.

Also, even when the wiping operation or a preliminary discharge operation serving as the discharge-recovery operation, other than the sucking operation, is performed midway through an image-forming-and-recording operation or even when the recording operation is temporarily interrupted, for example, in a time period while image data from the host device is transferred to the main body of the recording apparatus, a change in optical densities of a recording image similar to that occurring before and after the recording-operation interruption shown in FIG. 5 takes place.

In view of the above problem, according to the present invention, the discharge-recovery processing by means of the sucking operation serving as the recording-interruption operation during the image-forming-and-recording operation of the recording head is performed, and then a heating control of the recording heads is performed.

More particularly, after the start of the image-forming-and-recording operation of the recording heads 1, temperatures Ta1 to Ta4 of the plurality of recording heads 1 (four recording heads in the embodiment) immediately before the recording-interruption operation are measured, and an average temperature Tave1 of the temperatures Ta1 to Ta4 of the recording heads is computed and temporally stored in the controller 800. Meanwhile, in the present embodiment, temperatures of the recording heads are measured in every record-scanning operation, which will be described later, and thus the temperatures of the recording heads immediately before the recording-interruption operation are measured during the record-scanning operation immediately before the interruption operation. With this arrangement, a sucking operation is performed during the recording-interruption operation, temperatures Tb1 to Tb4 of the recording heads 1 before the discharge-recovery operation are measured when the recording-interruption operation is removed and the recording operation is resumed, and an average temperature Tave2 of the temperatures Tb1 to Tb4 is computed and temporally stored in the controller 800. In this case, the temperatures are obtained after an operation causing the interruption (sucking operation in the present embodiment) is finished. For example, FIG. 6 is a table showing examples of the temperatures Ta1 to Ta4 and Tb1 to Tb4 of the recording heads. As shown in the table, the average temperatures Tave1 and Tave2 are equal to 47.3° C. and 40° C., respectively.

Figure 7:
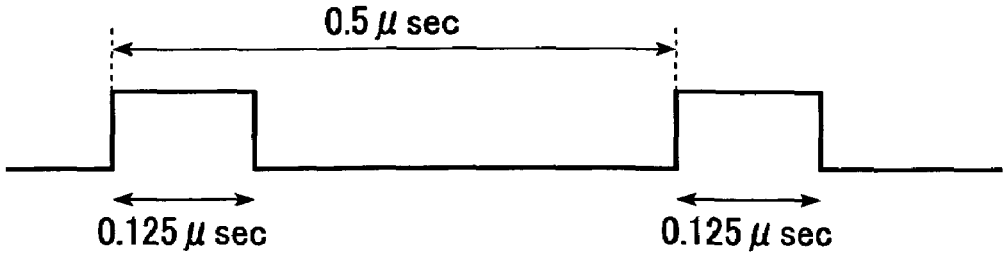
FIG. 7 illustrates example drive pulses used for a temperature control of the recording heads.

Then, the average temperatures Tave1 and Tave2 of the recording heads stored in the controller 800 are compared to each other, and the heating control of the recording heads for increasing the temperatures of the recording heads by applying short-width-pulse drive signals (shown in FIG. 7) (i.e., with application of short-width pulses), which do not cause ink in the recording heads to be discharged therefrom, on the electrothermal conversion members of the recording heads is performed until the temperature Tave2 attains to the temperature Tave1. When the temperature Tave2 attains to the temperature Tave1, the image-forming operation is resumed.

Figure 8:
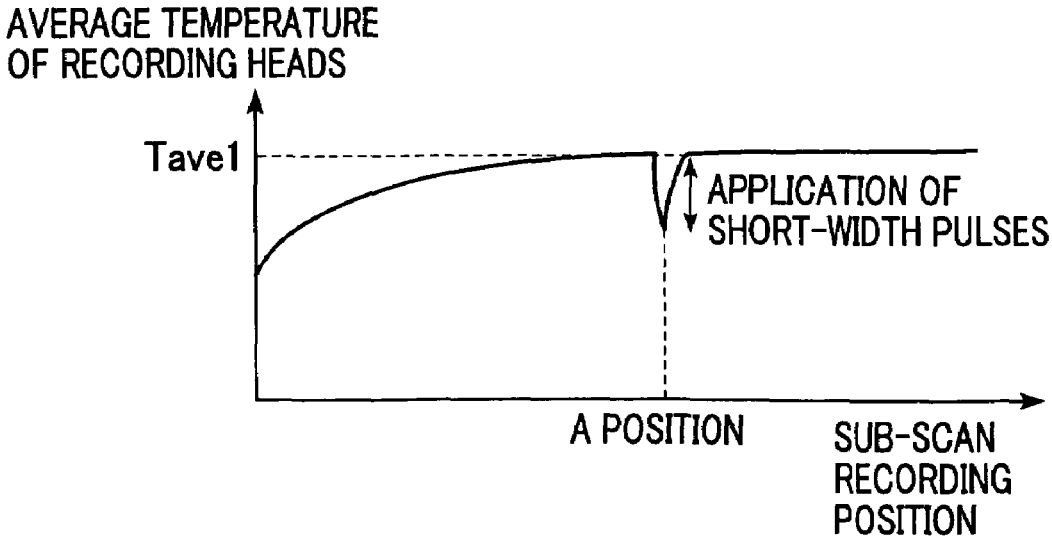
FIG. 8 illustrates an average temperature of the recording heads when short-width pulses are applied on the recording heads after a sucking operation serving as a recording-interruption operation.
Figure 9:
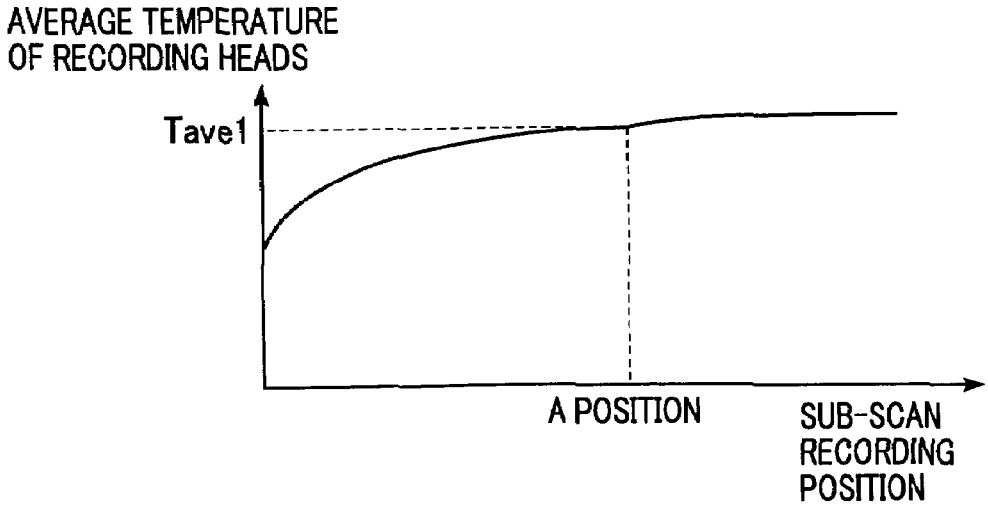
FIG. 9 is a graph illustrating how an average temperature of the recording heads changes when the heating control of the recording heads is performed after the sucking operation serving as the recording-interruption operation is performed.

FIG. 8 illustrates how the average temperature Tave1 of the recording heads changes when the heating control of the recording heads is performed after the recording-interruption operation by means of the sucking operation is performed midway through the image-forming-and-recording operation, as described above. A sub-scan recording position A shown in FIG. 8 represents a position where the sucking operation of the recording heads is performed likewise as in FIG. 3. The temperature of the recording head lying in a position preceding the position A and during the image-recording operation is higher than that immediately after the start of the image-recording operation, as previously described. Also, the temperature of the recording head lying at the sub-scan recording position A and immediately after the finish of the sucking operation is lower than that occurring before the discharge-recovery operation. As a countermeasure against the above problem, according to the present embodiment, the heating control of the recording heads is performed by applying drive pulses, such as short-width-pulses, to the recording heads immediately after the finish of the sucking operation and before the resumption of the image-recording operation, so that the average temperature of the recording heads immediately before the resumption of the image-forming operation is increased to the temperature Tave1, as shown in FIG. 9. As a result, a difference in optical densities of the recording image before and after the sucking operation for performing the discharge recovery processing serving as the recording-interruption operation decreases.

In the meantime, a further study of the inventors has revealed that the difference in optical densities of the recording image before and after the recording-interruption operation is affected not only by the above-described difference in temperatures of the recording heads but also by the length of the recording downtime.

More particularly, as described above, even when the average temperature of the recording heads Tave2 immediately before the resumption of the image-forming operation is increased up to the average temperature Tave1 before the recording-interruption operation by applying short-width-pulses on the recording heads before the resumption of the image-recording operation, as shown in FIG. 9, a recording-ink absorbing state of a recording medium and a blurring state of recording ink dots recorded on the recording medium vary depending on the length of the recording downtime, thereby causing a risk of producing a step-like drop in the optical density of an image at the position of interruption of the recording operation.

Figure 10:
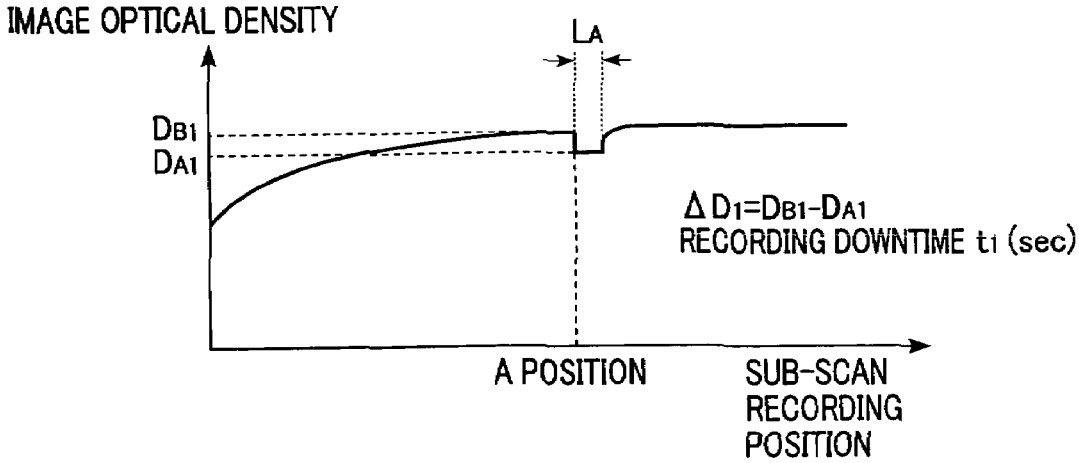
FIG. 10 is a graph illustrating how an image optical density changes when the heating control of the recording heads is performed after the sucking operation serving as the recording-interruption operation is performed.
Figure 11:
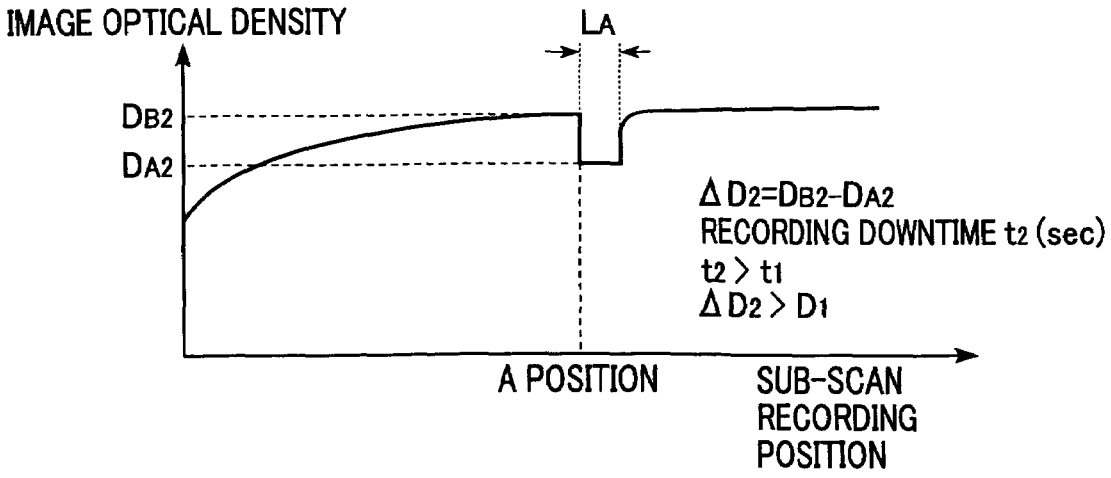
FIG. 11 is a graph illustrating how the image optical density changes when the heating control of the recording heads is performed after the sucking operation serving as the recording-interruption operation is performed and also when the downtime in this case is longer than that shown in FIG. 10.

FIGS. 10 and 11 are schematic graphs, each illustrating a difference in image optical densities affected by a recording-interruption downtime. In the case shown in FIG. 11 where a recording-interruption downtime t2 is equal to 2 seconds, a step-like difference ΔD2 (ΔD2=DB2−DA2, where DA2 and DB2 respectively represent optical densities immediately before and during the recording-interruption operation) in image optical densities is greater than a step-like difference ΔD1 (ΔD1=DB1−DA1, where DA1 and DB1 respectively represent optical densities immediately before and during the recording-interruption operation) in image optical densities occurring in the case shown in FIG. 10 where a recording-interruption downtime t1 is equal to 1 second (i.e., ΔD2>ΔD1 when t2>t1 is satisfied). The step-like difference in image optical densities during the recording interruption becomes greater as the recording-interruption downtime becomes longer.

The recording downtime in the present embodiment is defined as a time period from a time when a control command for the sucking operation, the wiping operation, the preliminary discharge operation, or a wait for transferring image data or the like is issued by a control unit such as the controller 800 when the carriage having the recording heads mounted thereon is in the process of continuously performing the recording operation while performing the serial scanning operations in the main-scan directions, through a temporal halt of the moving operation of the carriage, a halt of the recording operation of the recording heads, a removal of the command for the recording interruption, and the resumption of the moving operation of the carriage in the main-scan directions, to another time when a command for the resumption of the recording operation is issued.

Meanwhile, accurate timings of an interruption start and an interruption removal for determining the downtime may be appropriately determined in view of the amount of heating for blur correction in accordance with the downtime, and are not limited to the above example.

The heating control for preventing blurring is performed immediately before the recording operation. Also, the reference character LA in the figures represents a recording width of plurality of nozzles of the recording heads.

Figure 12:
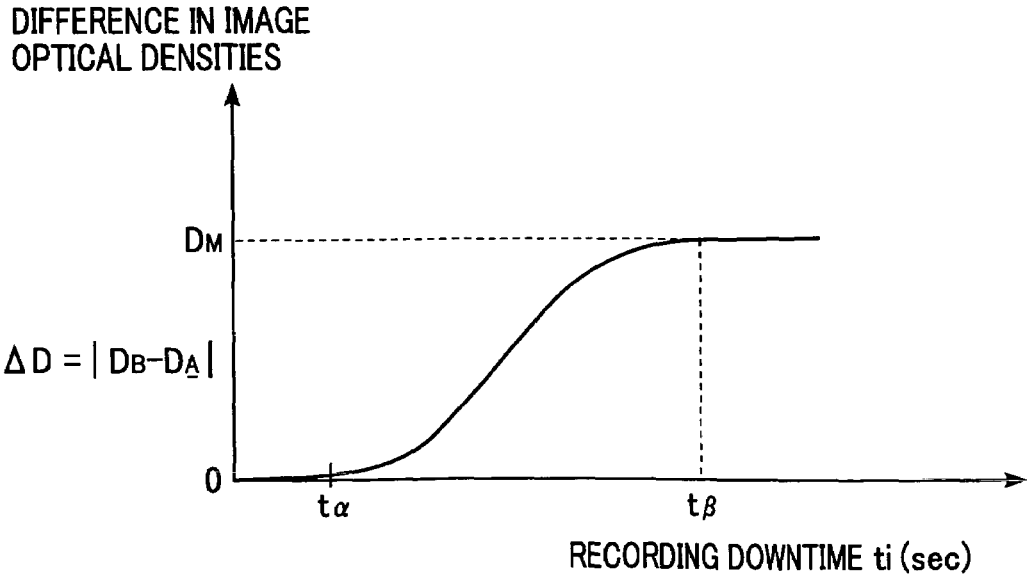
FIG. 12 is a graph illustrating the relationship between a difference in image optical densities and a recording downtime.

FIG. 12 is a graph illustrating the relationship between a recording downtime ti of the recording heads and a difference ΔD (=DB−DA, where DA and DB respectively represent optical densities immediately before and during the recording-interruption operation) in recording-image optical densities before and after the recording-interruption operation. When the recording downtime ti is short, little difference ΔD in recording-image optical densities takes place. The recording-image optical density immediately after the resumption of the recording operation decreases gradually as the recording downtime ti becomes longer than tα, and thus the difference in recording-image optical densities before and after the recording-interruption operation starts to occur. After then, the difference ΔD in recording-image optical densities becomes gradually greater as the recording downtime ti becomes longer, and when the recording downtime ti becomes further longer up to tβ (tβ>tα), the difference in the recording-image optical densities becomes saturated (ΔD=DM when ti>tβ, where DM is a saturated value).

With this in mind, the recording apparatus according to the embodiment of the present invention is controlled such that, when the recording-interruption operation is performed, the recording operation is resumed after the heating control of the recording heads is performed in accordance with the length of the recording downtime so as to prevent occurrence of the difference in recording-image optical densities before and after the recording-interruption operation even when the recording downtime differs depending on recording cases.

Figures 13, 14:
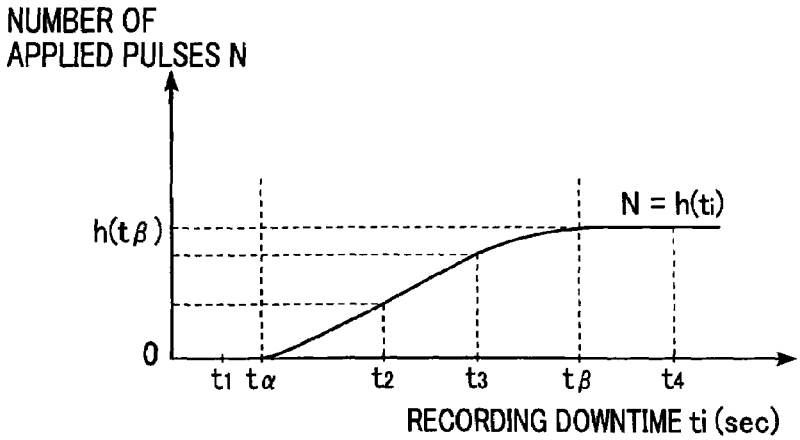
FIG. 13 illustrates the relationship between the number of blur-correction pulses and a recording downtime.
FIG. 14 is a correction table showing the relationship between the number of blur-correction pulses and a recording downtime.

That is, as shown in FIG. 13, in the recording apparatus according to the present embodiment, the heating control of the recording heads is performed such that, when the recording-interruption operation is performed, the short-width pulses for blur correction are applied during the recording downtime by changing the number N of short-width pulses for heating in accordance with the length of the recording downtime. Then, the recording apparatus is controlled so as to resume the recording operation after the short-width pulses for blur correction are further applied.

As described above, referring back to the graph shown in FIG. 12, since the difference ΔD (=DB−DA) in recording-image optical densities before and after the recording interruption occurs little when the recording downtime ti of the recording heads is shorter than tα, when the recording downtime ti is equal to tα or shorter, the following formula is set:

$$\text{Number of blur-correction pulses } N=0(0<ti\leqq t\alpha).$$

Since the recording-image optical density immediately after the resumption of the recording operation decreases gradually as the recording downtime ti becomes longer than tα, and accordingly the difference in the recording-image optical densities before and after the recording-interruption operation starts to occur, the number N of blur-correction pulses to be applied on the recording head is gradually increased in accordance with the downtime, according to the following formula:

$$\text{Number of blur-correction pulses } N=h(ti)\ (t\alpha<ti\leqq t\beta).$$

Since the difference in the recording-image optical densities becomes saturated when the recording downtime ti becomes longer than tβ, the number N of blur-correction pulses to be applied on the recording heads is set constant as expressed by the following formula:

$$\text{Number of blur-correction pulses } N=h(t\beta)\ (=\text{constant})\ (t\beta<ti).$$

Alternatively, it is possible to previously obtain a formula of the number of blur-correction pulses N=h(ti) in an experimental manner and to compute the number N of blur-correction pulses with the CPU 801 of the controller 800 on the basis of the recording downtime ti from the recording-downtime detecting means.

Still alternatively, by previously preparing a table establishing the relationship between the number N of blur-correction pulses and the recording downtime ti as shown in FIG. 14 and by storing it in the ROM 802 of the controller 800, the number N of blur-correction pulses may be computed on the basis of the table stored in the ROM 802 of the controller 800 when the recording downtime ti of the recording heads is detected by the recording-downtime detecting means.

Figure 15:
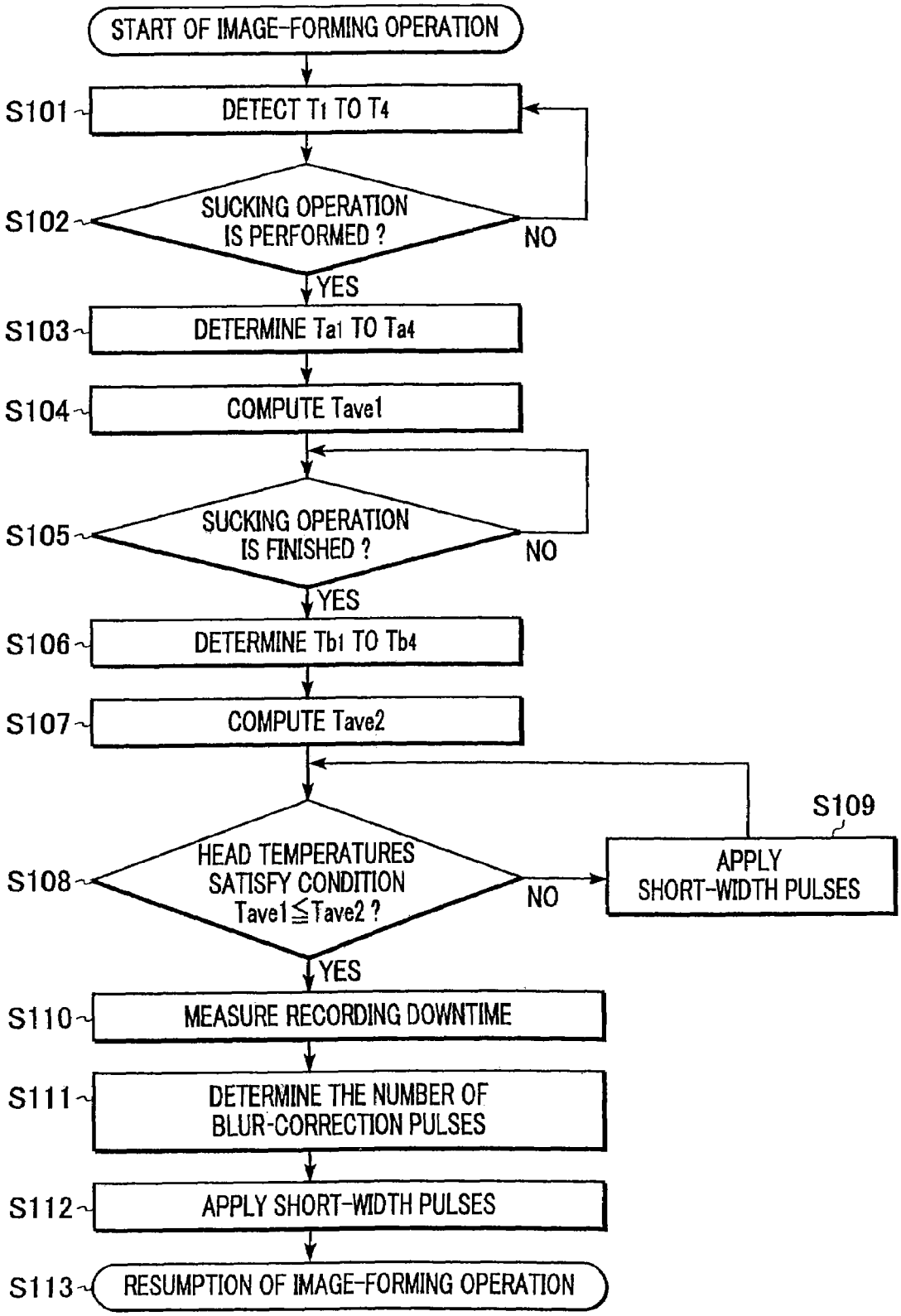
FIG. 15 is a flowchart illustrating an image-recording operation of the recording apparatus from its start to resumption when the discharge-recovery processing serving as the recording-interruption operation is performed.

FIG. 15 is a flowchart illustrating a control method of the inkjet recording apparatus according to the first embodiment of the present invention when the recording-interruption operation is performed. After the start of the image-forming-and-recording operation of the recording heads 1, temperatures of T1 to T4 of the plurality of recording heads 1 (four recording heads in the present embodiment) are measured in Step S101 by the temperature sensor 50 serving as means for detecting the temperatures of the recording heads and are temporally stored in the controller 800.

The timing of storing the above data lies in a standby time from the finish of one scanning operation to the start of the subsequent scanning operation. It is determined in Step S102 whether the sucking operation is performed during this standby time. When the sucking operation is not performed, the temperatures of Ta1 to Ta4 of the plurality of recording heads 1 obtained in the last scanning operation are overwritten with those obtained in the subsequent scanning operation, and the latter ones are stored.

When the sucking operation is performed during the standby time, the process advances to Step S103, and the temperatures stored at this moment are determined as the temperatures Ta1 to Ta4 of the recording heads 1 before the start of discharge-recovery operation. Then, the average Tave1 of the temperatures Ta1 to Ta4 is computed and stored in the controller 800 in Step S104.

When the sucking operation is finished in Step S105, the temperatures Tbl to Tb4 of the recording heads after the sucking operation are measured and detected in Step S106 by the temperature sensor 50, and the average Tave2 of the temperatures Tb1 to Tb4 is before the recording-interruption operation stored in the controller 800. When the average temperature Tave2 after the sucking operation is lower than the average temperature Tave1 before the sucking operation, the process moves to Step S109, and the heating control of the recording heads is performed until the temperature Tave2 attains to the temperature Tave1 by applying short-width-pulses for temperature compensation on the recording heads, which do not cause ink in the recording heads to be discharged therefrom.

When the temperature Tave2 attains to the temperature Tave1, the process advances to Step S110, and the recording downtime caused by the sucking operation is measured by the timer 812 serving as recording-downtime detecting means. Subsequently, the number of blur-correction pulses is computed with the controller 800 in Step S111, the short-width pulses corresponding to the computed number of blur-correction pluses are applied on the recording heads in Step S112, and then the image-recording operation of the recording heads is resumed in Step S113.

Meanwhile, the downtime may be measured by the timer only during the interruption operation. Alternatively, only the downtime may be drawn from a time period continuously measured regardless of interruption. Still alternatively, when a time period for the sucking operation and the like is fixed, the downtime may be obtained by, for example, summing up the fixed time period and a time period measured by the timer.

The present invention is effective to the case where the recording operation is temporally interrupted after the wiping operation or the preliminary discharge operation serving as the recording-interruption operation, other than the sucking operation serving as the discharge-recovery operation, is performed midway through the recording operation or until image data from the host device is transferred to the main body of the recording apparatus. Against to this interruption operation in the same fashion as against the interruption caused by the sucking operation, after the heating control of the recording heads is performed so as to apply short-width pulses for temperature compensation after the recording-interruption operation, and also a short-width pulse application control for blur correction is performed in accordance with a difference in recording downtimes, the image-forming operation is resumed, thereby recording a high quality image without differences in optical densities and colors of a recording image before and after the recording-interruption operation. Also, the recording-interruption operation may be performed not only by the discharge-recovery operation but also by one of the other processing operations.

In the present embodiment, although the short-width pulse heating is employed as an example for performing a control for preventing a difference in temperatures of the recording heads before and after the interruption of the recording operation and for performing the heating control of the recording heads for blur correction in accordance with a difference in recording downtimes, the effect of the present invention is satisfactorily achieved even when the temperatures of the recording heads are controlled by applying drive pulses, having such a pulse width as to discharge ink from the recording heads, on the recording heads so as to cause the recording heads to discharge ink into the cap for recovery or by mixing the short-width pulses for the short-width pulse drive and the drive pulses having such a pulse width as to discharge ink from the recording heads.

In addition, when the recording apparatus has heating elements disposed in the respective recording heads independently of heater elements for discharging ink disposed in the same, and heating means disposed outside the recording heads so as to abut against the recording heads, the temperatures of the recording heads may be controlled by using these recording-head heating means or by combining these recording-head heating means and the drive pulses applied on the recording heads.

Also, in the present embodiment, although the average temperatures of the plurality of recording heads are computed as the temperatures of the recording heads before and after the interruption of the recording operation, the effect of the present invention can be further improved by independently detecting each of the temperatures of each recording head before and after the interruption of the recording operation and by performing the heating control of the recording heads.

Second Embodiment

Figure 16:
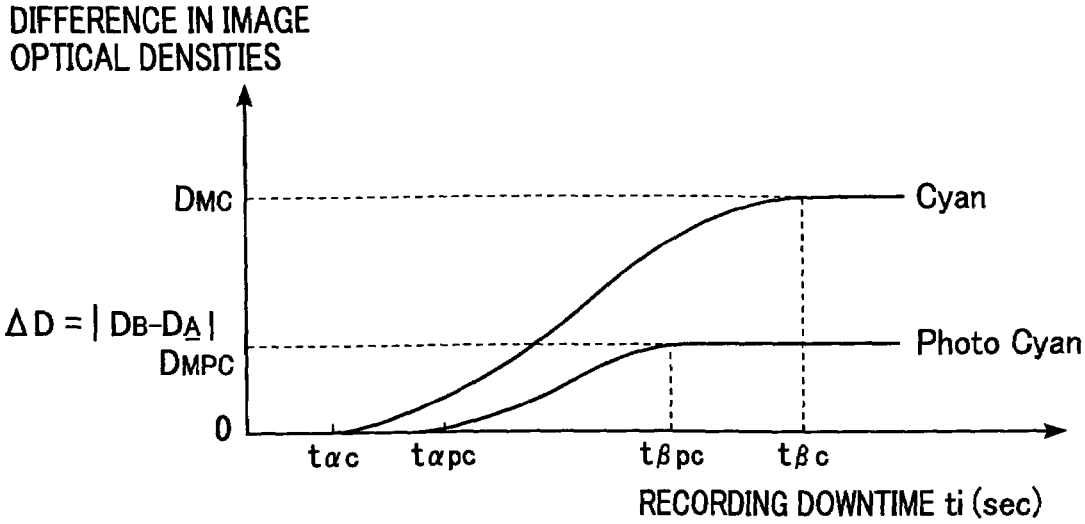
FIG. 16 is a graph illustrating the relationships between a recording downtime and differences in optical densities of images recorded with mutually different colors of ink.

FIG. 16 is a graph illustrating an inkjet recording apparatus according to a second embodiment of the present invention. In the second embodiment, in view of the fact that a recording-ink absorbing state of a recording medium and a blurring state of recording ink dots recorded on the recording medium, both appearing during the interruption of the recording operation of recording-heads in accordance with the length of the recording downtime, vary depending on kinds of recording ink, a further optimal control method for preventing a step-like drop in the optical density of an image at the position of interruption of the recording operation is proposed.

Although, in the inkjet recording apparatus according to the first embodiment, an image is recorded with four kinds of recording ink for four colors: cyan, magenta, yellow, and black, inkjet recording apparatuses in which an image is recorded with six recording ink colors including two kinds of ink having a low density such as photo cyan ink and photo magenta ink in addition to the foregoing four kinds of recording ink for the four colors has been launched in recent years on the market by various manufacturers.

A study of the inventors has revealed that a level of the difference in recording-image optical densities, occurring in accordance with the length of the recording downtime, varies depending on photo hypochromic ink having a low density and normal hyperchromic ink having a high density since the recording-ink absorbing state varies depending on the above-mentioned two kinds of ink.

With this study in mind, in the recording apparatus according to the second embodiment of the present invention, the recording heads during the interruption of the recording operation are optimally controlled depending on the kinds of recording ink so as to record a higher-quality image.

More particularly, as shown in FIG. 16, when the recording downtime ti varies, a gradually decreasing characteristic and a change in optical densities of a recording image immediately after the resumption of the recording operation vary depending on the kinds of recording ink, and a difference in recording-image optical densities caused by hyperchromic cyan ink having a high density is more likely to occur even in a short downtime range; whereas, a difference in recording-image optical densities caused by photo hypochromic cyan ink having a low density is unlikely to occur even when the recording downtime is the same as that caused by the hyperchromic cyan ink, and also the magnitude of the difference caused by photo hypochromic cyan ink is smaller.

Also, as shown in the graph, with respect to the hyperchromic cyan ink, the difference $\Delta D$ (=DB−DA) in recording-image optical densities before and after the interruption of the recording operation occurs little until the recording downtime ti of the recording heads reaches a recording downtime $t\alpha c$. As the recording downtime ti becomes longer than $t\alpha c$, the recording-image optical density immediately after the resumption of the recording operation decreases gradually and the difference in recording-image optical densities before and after the recording-interruption operation starts to take place. Then, the difference $\Delta D$ in recording-image optical densities becomes gradually greater as the recording downtime ti becomes longer, and when the recording downtime ti becomes further longer and reaches a recording downtime $t\beta c$ ($t\beta c > t\alpha c$), the difference $\Delta D$ (=DMc, where $ti > t\beta c$) in the recording-image optical densities becomes saturated.

Meanwhile, with respect to the photo hypochromic cyan ink, the difference $\Delta D$ in recording-image optical densities does not take place until the downtime ti reaches a recording downtime $t\alpha pc$ ($t\alpha c < t\alpha pc$) which is longer than that with respect to the hyperchromic cyan ink, and also the difference in recording-image optical densities becomes saturated at a recording downtime $t\beta pc$ which is shorter than that with respect to the hyperchromic cyan ink (where, $t\alpha c < t\alpha pc < t\beta pc < t\beta c$).

Figure 17:
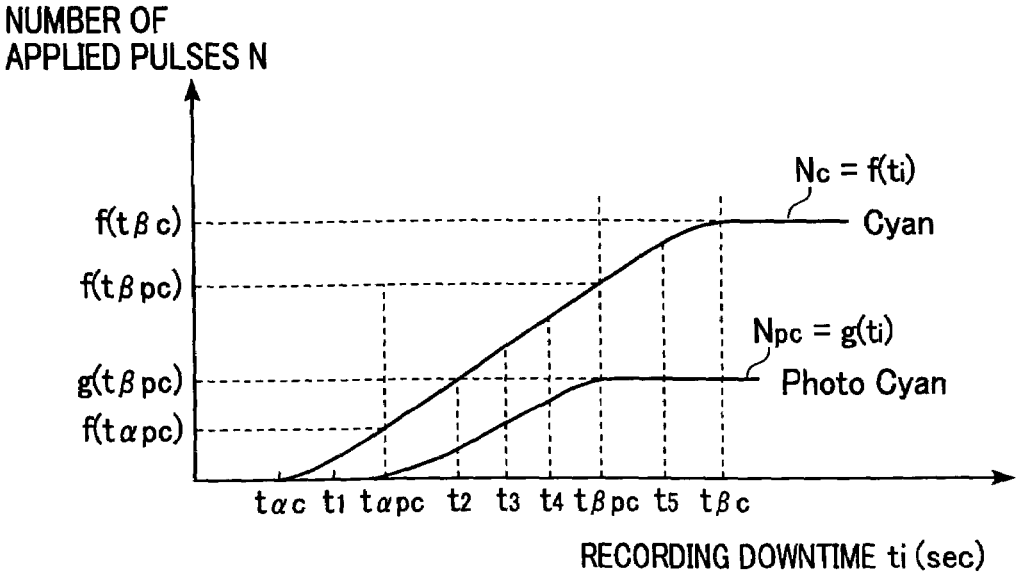
FIG. 17 is a graph illustrating the relationships between a recording downtime and the numbers of blur-correction pulses of images recorded with the mutually different colors of ink.

Thus, in the present embodiment, as shown in FIG. 17, as the numbers of blur-correction pulses to be applied on the corresponding recording heads for the hyperchromic cyan ink and the photo hypocbromic cyan ink, two formulas of the numbers of blur-correction pulses $N=f(ti)$ and $N=g(ti)$ are previously obtained by means of experimental measurement and independently from each other. With this arrangement, the recording apparatus is controlled such that, after the recording downtime ti during the interruption of the recording operation of the recording heads is detected by the timer 812 serving as the recording-downtime detecting means, the number N of blur-correction pulses corresponding to each recording ink color is computed with the CPU 801 of the controller 800, and the computed blur-correction pulses corresponding to each recording ink color are applied on the corresponding recording head immediately before the resumption of the recording operation.

Thus, according to the present embodiment, the number N of blur-correction pulses to be applied on each recording head during the interruption of the recording operation is optimally determined in accordance with the corresponding kind of color of recording ink discharged from the recording head so as to minimize the difference in recording-image optical densities before and after the recording-interruption operation, thereby recording an image having higher image quality before and after the recording-interruption operation.

FIG. 18 is a correction table showing the relationships between a recording downtime ti and the numbers N of blur-correction pulses of images recorded with the hyperchromic cyan ink and the photo hypochromic cyan ink, the two relationships being prepared independently from each other.

With this arrangement, the recording apparatus according to the second embodiment can be controlled such that the table of the numbers of blur-correction pulses for the hyperchromic cyan ink and the photo hypochromic cyan ink is stored in the ROM 802 of the controller 800; when the recording downtime ti of the recording heads is detected by the timer 812 serving as the recording-downtime detecting means, the numbers N of blur-correction pulses are computed on the basis of the table stored in the ROM 802 of the controller 800; and then the computed blur-correction pulses are applied on the corresponding recording heads immediately before the resumption of the recording operation.

Among a variety of inkjet recording apparatuses, the present invention is especially effective to a thermal inkjet recording apparatus in which ink is discharged with thermal energy. Such a recording apparatus achieves a higher density and a higher definition of a recorded image.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A recording apparatus for recording an image by applying ink on a recording medium with at least one recording head, the recording head discharging ink by applying thermal energy, comprising:

a timer for measuring a recording downtime when an image-recording operation of the recording head is interrupted during the recording operation and is then resumed;

control means for performing a temperature control of the recording head by applying drive pulses before the resumption of the recording operation, in accordance with the length of the recording downtime measured by said timer; and a temperature sensor for detecting a temperature of the recording head, wherein, with said control means, the recording head is heated before the resumption of the recording operation to a temperature of the recording head detected by said temperature sensor before the interruption of the recording operation and is further heated in accordance with the length of the measured recording downtime, and wherein, with said control means, the number of drive pulses to be applied to the recording head is increased as the recording downtime becomes longer.

2. The recording apparatus according to claim 1, wherein interruption of the recording operation during an image-recording operation is executed midway through a recording operation of a continuous image.

3. The recording apparatus according to claim 1, wherein, with the temperature control, an electrothermal conversion member disposed in the recording head is heated to the extent of not causing ink in the recording head to be discharged therefrom.

4. The recording apparatus according to claim 1, wherein said temperature sensor detects temperatures of the recording head before and after the interruption of the recording operation, wherein, with said control means, the temperature control of the recording head is performed before the resumption of the recording operation in accordance with detected temperatures before and after the interruption of the recording operation and is further performed in accordance with the length of a recording downtime detected thereafter.

5. The recording apparatus according to claim 1, wherein the at least one recording head comprises a plurality of recording heads for different recording ink colors, and with said control means, the temperature control of each of the plurality of recording heads for the different recording ink colors is performed in accordance with the measured length of interruption of the recording operation.

6. A control method of a recording apparatus for recording an image by applying ink on a recording medium with at least one recording head, the recording head discharging ink by applying thermal energy, comprising the steps of:

measuring a recording downtime with a timer when an image-recording operation of the recording head is temporally interrupted during the recording operation and is then resumed;

performing a temperature control of the recording head by applying drive pulses before the resumption of the recording operation in accordance with the length of the recording downtime measured by the timer; and detecting a temperature of the recording head, wherein, in the step of performing the temperature control of the recording head, the recording head is heated before the resumption of the recording operation to a temperature detected by a temperature sensor before the interruption of the recording operation, and is further heated in accordance with the length of the measured recording downtime, and wherein, in the step of performing the temperature control of the recording head, the number of drive pulses to be applied to the recording head is increased as the recording downtime becomes longer.

7. The control method according to claim 6, wherein interruption of the recording operation during an image-recording operation is executed midway through a recording operation of a continuous image.

8. The control method according to claim 6, wherein, in the step of performing the temperature control of the recording head, an electrothermal conversion member disposed in the recording head is heated to the extent of not causing ink in the recording head to be discharged therefrom.

9. The control method according to claim 6, wherein, in the step of performing the temperature control of the recording head, the recording head is heated before the resumption of the recording operation to a temperature exceeding that detected by a temperature sensor before the interruption of the recording operation, and an extent to which the temperature exceeds that before the interruption of the recording operation varies in accordance with the length of the measured recording downtime.

10. The control method according to claim 6, wherein in the temperature detecting step temperatures of the recording head are detected before and after the interruption of the recording operation, and, in the step of performing the temperature control of the recording head, the temperature control of the recording head is performed before the resumption of the recording head in accordance with detected temperatures of the recording head before and after the interruption of the recording operation and is further performed in accordance with the length of a recording downtime detected thereafter.

11. The control method according to claim 6, wherein the at least one recording head comprises a plurality of recording heads for different recording ink colors, and, in the step of performing the temperature control of the plurality of recording heads for the different recording ink colors, the heating control of each recording head is performed in accordance with the measured length of interruption of the recording operation.

* * * * *

UNITED STATES PATENT AND TRADEMARK OFFICE

CERTIFICATE OF CORRECTION

PATENT NO. : 7,185,965 B2
APPLICATION NO. : 10/690516
DATED : March 6, 2007
INVENTOR(S) : Takada et al.

It is certified that error appears in the above-identified patent and that said Letters Patent is hereby corrected as shown below:

COLUMN 6:
Line 2, “recording,” should read --recording--.

COLUMN 12:
Line 27, “is” should read --is computed in step S107 and is compared in step S108 with the average temperature Tave1--.

COLUMN 14:
Line 54, “hypocbromic” should read --hypochromic--.

Signed and Sealed this

Third Day of February, 2009

JOHN DOLL
*Acting Director of the United States Patent and Trademark Office*